US006881035B1

(12) United States Patent
Paulsen

(10) Patent No.: US 6,881,035 B1
(45) Date of Patent: Apr. 19, 2005

(54) DRAFT INDUCER HAVING SINGLE PIECE METAL IMPELLER AND IMPROVED HOUSING

(75) Inventor: Frederick D. Paulsen, Holiday Island, AR (US)

(73) Assignee: Fasco Industries, Inc., Cassville, MO (US)

( * ) Notice: Subject to any disclaimer, the term of this patent is extended or adjusted under 35 U.S.C. 154(b) by 60 days.

(21) Appl. No.: 10/335,836

(22) Filed: Jan. 2, 2003

(51) Int. Cl.[7] ..... F01D 5/14
(52) U.S. Cl. ..... 416/183; 416/223 B; 416/DIG. 3
(58) Field of Search ..... 415/93, 101, 102, 415/108, 121.3, 175, 176, 177, 178, 180, 415/212.1; 416/182, 183, 185, 223 B, 234, 416/243, DIG. 3

(56) References Cited

U.S. PATENT DOCUMENTS

| | | | | |
|---|---|---|---|---|
| 2,188,741 | A * | 1/1940 | Roberts | 415/206 |
| 3,403,962 | A * | 10/1968 | Suffron et al. | 431/20 |
| 3,692,428 | A | 9/1972 | Bubb et al. | 416/187 |
| 3,846,043 | A | 11/1974 | Wolbrink et al. | 416/183 |
| 5,125,799 | A * | 6/1992 | Sato et al. | 416/223 B |
| 5,375,651 | A * | 12/1994 | Colwell | 415/214.1 |
| 5,478,206 | A | 12/1995 | Prahst | 416/186 |
| 5,685,695 | A * | 11/1997 | Klement et al. | 416/DIG. 3 |
| 5,895,206 | A | 4/1999 | Chuang et al. | 416/189 |
| 6,095,752 | A | 8/2000 | Gronier et al. | 416/186 |
| 6,314,894 | B1 | 11/2001 | Gatley, Jr. | 110/341 |
| 6,468,034 | B1 | 10/2002 | Garrison et al. | 415/212.1 |
| 6,537,030 | B1 | 3/2003 | Garrison | 416/185 |

OTHER PUBLICATIONS

Impeller Assembly, Part No. 8710 4765, Fasco Industries Engineering Drawing, Admitted prior art.
Blower Assembly, Part No. 7021 10215, Fasco Industries Engineering Drawing, admitted prior art.

* cited by examiner

*Primary Examiner*—Edward K. Look
*Assistant Examiner*—Richard A. Edgar
(74) *Attorney, Agent, or Firm*—Andrus, Sceales, Starke & Sawall, LLP

(57) ABSTRACT

A furnace blower assembly having a single piece impeller formed from a stamped metal material. The impeller of the blower assembly is formed from a single piece of metal material and includes a plurality of individual impeller blades each having a blade portion bent at a 90° angle relative to the back wall of the impeller. Each of the impeller blades is backward inclined and forward curved to increase the efficiency of the impeller.

9 Claims, 9 Drawing Sheets

DRAFT INDUCER HAVING SINGLE PIECE METAL IMPELLER AND IMPROVED HOUSING

FIELD OF THE INVENTION

The present invention generally relates to a blower housing and impeller for use in a blower assembly used to withdraw exhaust gases from a furnace. More specifically, the present invention relates to a one-piece stamped metal impeller design having backward inclined forward curved (cupped in the direction of rotation) impeller blades for use in a blower to decrease the cost of the blower while maintaining the desired efficiency and air flow characteristics.

BACKGROUND OF THE INVENTION

The need to heat structures to control the interior temperature has been a requirement for modern housing for many years. One of the current popular methods to heat a structure is with a furnace that burns either oil or natural gas. Due to the increasing cost of fossil fuels, the operating efficiency of such furnaces has become a greater and greater concern.

One common method of increasing the fuel efficiency of a burner within a furnace has been to utilize a blower assembly to induce a draft through the furnace to draw the heated air and the products of combustion through a heat exchanger and exhaust the gases through an exhaust pipe. The blower assembly includes a rotating impeller that creates a source of negative air pressure. The negative air pressure in the bower housing increases the draft such that the heated air and the products of combustion can travel through as tortured a path as possible to increase the amount of heat removed from the exhaust gases within the heat exchanger. The increase in the flow of air thereby increases the heat transfer and generating capacity of the burner while simultaneously using less fuel per BTU of heat generated. The addition of a blower assembly to a furnace generates a rating of about 80% fuel efficiency in a modern furnace. Thus, it is clearly a necessity to introduce a blower assembly to a modem furnace to maintain minimum desired efficiency standards.

In an 80+ furnace (which refers to a furnace that is at least 80% efficient), the temperature of the exhaust gases withdrawn from the furnace are typically in the range of 350° F. and these gases are drawn into the open interior of the blower housing by the rotating impeller. As such, the blower housing for an 80+ furnace must be durable enough to withstand the heat and is thus typically made from sheet metal. Further, the impeller utilized with such a blower assembly must also withstand the same temperature and is typically also made from a metal material.

Currently, an 80+ blower assembly utilizes one of two types of impellers. The first type of impeller is referred to as a squirrel cage impeller. A squirrel cage impeller includes a metallic, circular back plate having a plurality of forward curved impeller blades extending perpendicular to the generally planar back plate. Each of the impeller blades extends radially from the center of the back plate out to the circumferential outer edges of the back plate. The plurality of individual impeller blades are secured to the back plate individually by a metal forming technique. Additionally, the axial outer edges of the impeller blades are secured to each other by an inlet ring that is individually fixed to the axial outer edges of each of the impeller blades. During the construction of the squirrel cage impeller, numerous metal working steps are required to attach the impeller blades to the back plate and finally secure the impeller blades to each other by the inlet ring. Thus, the labor and material costs to produce a squirrel cage impeller are significant.

The second type of impeller currently utilized in an 80+ furnace is a stamped impeller formed from a single sheet of metal. In the currently available stamped sheet metal impellers, each of the impeller blades extends radially from a central location. The height of the impeller blades is dictated by the number of individual blades, since the material between the blades is used to form the axially extending blade portion of the blade. Although the radial blade, one-piece sheet metal impeller reduces the cost of producing the impeller as compared to a squirrel cage impeller, the performance characteristics of the currently available single piece stamped sheet metal impellers do not meet current performance standards and thus has limited the use of such impellers in blower assemblies.

In addition, many currently available blower assemblies include a slinger fan mounted to the motor shaft and positioned to the exterior of the impeller cavity created by the blower housing. The slinger fan includes a plurality of fan blades that rotate along with the motor shaft and create a flow of air over the drive motor to both cool the motor and create a buffer of air between the heated exhaust gases in the impeller cavity of the blower assembly and the operating components of the drive motor. Although the slinger fan creates the desired cooling effect, the slinger fan increases the drag on the rotation of the motor shaft and thus requires a larger motor size to create the desired air flow characteristics by the impeller included in the impeller cavity of the blower assembly. Further, the slinger fan increases the material and assembly costs of the blower assembly.

The present invention addresses the problems identified above with a novel and cost efficient solution. The present invention solves the above stated problems with an easy to manufacture and assemble solution that has eluded manufacturers for years.

SUMMARY OF THE INVENTION

The present invention relates to a blower assembly for use in expelling exhaust gases from a furnace or other type of heating device. The blower assembly includes a blower housing formed from a two-piece construction of stamped steel members joined to each other. One of the housing members that forms the blower housing includes a top wall that supports the drive motor of the blower assembly. The top wall of the blower housing includes a raised plenum that extends from the otherwise planar top wall. The raised plenum is defined by an outer wall and a plenum top wall. The outer wall and plenum top wall define a plenum cavity within the blower housing. The plenum cavity is in communication with the impeller cavity formed by the blower housing.

The drive shaft of the drive motor extends through the top wall of the raised plenum into the impeller cavity formed by the blower housing. In accordance with the present invention, a small opening or gap is formed in the top wall of the plenum surrounding the drive shaft. The gap allows the drive shaft to freely rotate and allows a small flow of ambient air to enter into the plenum cavity due to the negative pressure created by the rotating impeller within the impeller cavity. The small flow of ambient air into the plenum cavity creates a buffer of cooler air between the hot exhaust gases in the impeller cavity and the drive motor mounted to the exterior of the top wall of the plenum.

The buffer of cooler air contained in the plenum cavity allows the blower assembly of the present invention to eliminate the use of a slinger fan to create the similar buffer of air between the hot exhaust gases and the drive motor. The elimination of the slinger fan reduces the rotational load on the drive shaft, thereby allowing for a smaller drive motor to be used while generating the same operating efficiency for the impeller.

The blower assembly of the present invention further includes a single piece metal impeller. The impeller is preferably stamped from a planar supply of sheet metal. The impeller includes a plurality of individual impeller blades that each radially extend from a central, rotational axis. Each of the impeller blades includes a back wall and an upstanding blade portion. The blade portion is formed by stamping the shape of the blade portion from the planar sheet of material and bending the blade portion to a 90° angle relative to the back wall.

The blade portion of each impeller blade includes a face surface that extends from a leading edge to a trailing outer edge. The face surface includes a backward inclined forward curve from the leading edge at the inlet to the trailing edge at the impeller outer diameter. The forward curve of the impeller blade allows for a more optimum inlet angle which increases the efficiency and flow rates created by the rotating impeller. In accordance with the present invention, the blade portion of each impeller blade is forward curved with an inlet angle approximately between 15° and 25° relative to a line tangent to the inlet diameter of the impeller to create the desired operating characteristics.

The air flow and static pressure in a blower assembly can be further increased by using a larger diameter impeller. In order to increase the impeller diameter and maintain the same overall housing size, it is necessary to reduce the housing diffuser (expansion) angle. A significant reduction of the diffuser angle greatly reduces the efficiency of a forward curved squirrel cage type impeller. Since a backward inclined (blade leading edge at impeller inlet) forward curved impeller develops most of its static pressure on its blades surfaces, it is therefore less dependent on the housing diffuser angle. A backward inclined forward curved impeller, such as the blower assembly of the present invention, can operate with high efficiency in a housing with little or no diffuser angle.

The back wall of the impeller includes a series of protruding ribs that are formed into the otherwise planar surface. Each of the ribs extends radially outward and is aligned with one of the impeller blades. The protruding ribs provide additional structural stability for each of the impeller blades.

As described above, the blower assembly of the present invention includes a single piece stamped impeller formed from sheet metal. The impeller includes backward inclined forward-curved impeller blades that increase the efficiency and operating characteristics of the blower as compared to prior art blowers utilizing single piece stamped sheet metal impellers having radial blades. Further, the blower assembly of the present invention includes a blower housing having a raised plenum that creates a buffer of air between the heated exhaust gases within the impeller cavity and the drive motor. The use of the raised plenum on the top wall of the blower housing allows for the elimination of a slinger fan, thereby reducing the load on the drive motor.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
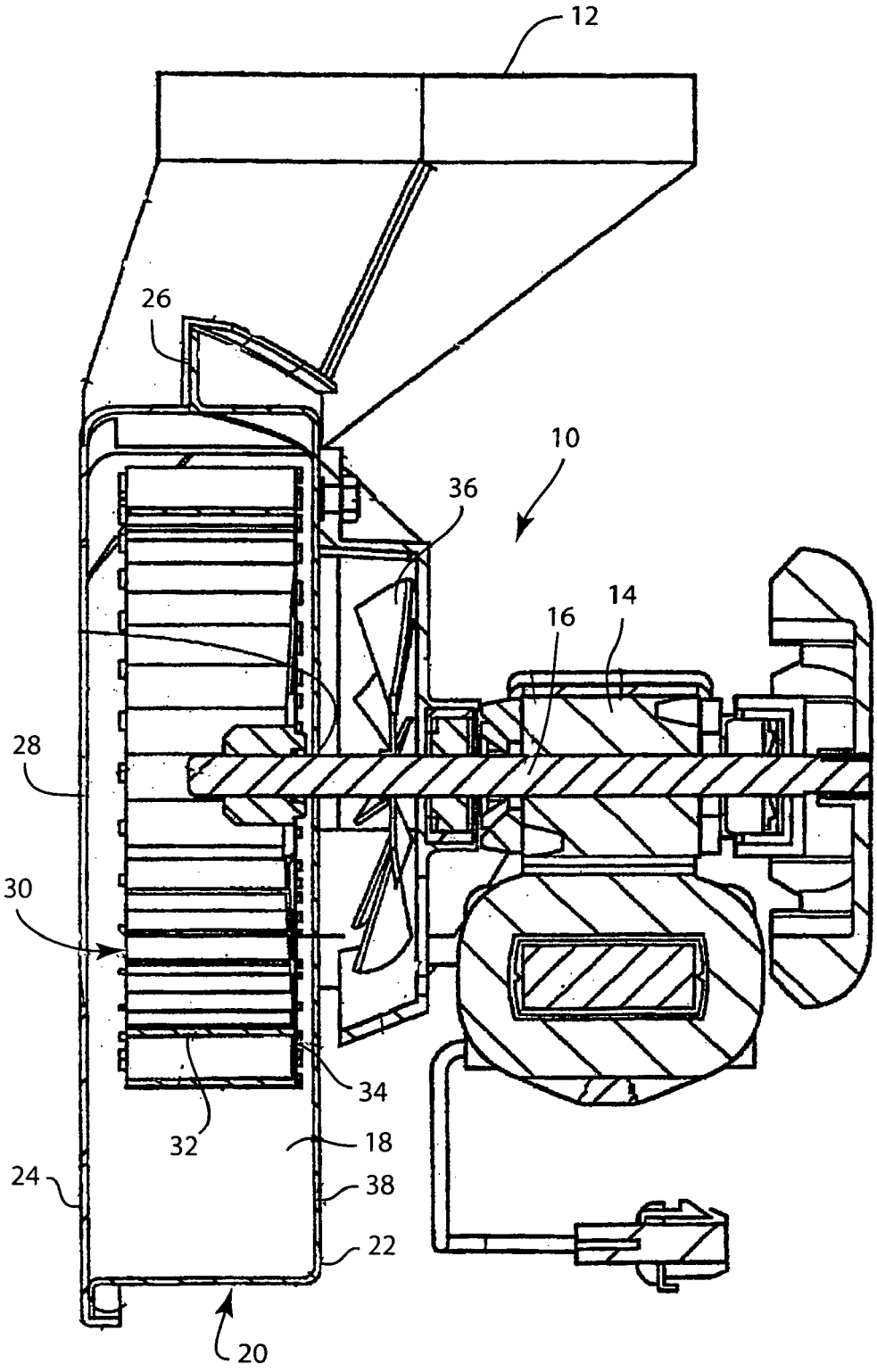
FIG. 1 PRIOR ART
FIG. 1 is a section view of a prior art blower assembly illustrating a squirrel cage impeller and a slinger fan positioned on the exterior of the blower housing.

Referring first to FIG. 1, thereshown is a prior art blower assembly 10. The blower assembly 10 is used on an 80+ furnace to expel exhaust gases from the furnace out through an exhaust outlet 12 that is connected to a flue pipe (not shown) for directing the exhaust gases out of the building in which the furnace is located. The prior art blower assembly 10 includes a drive motor 14 having a drive shaft 16 that extends into the impeller cavity 18 formed by the blower housing 20. In the embodiment of the invention illustrated, the blower housing 20 is formed from a pair of stamped sheet metal housing sections 22 and 24 joined to each other along a cinch seam 26.

The blower housing 20 includes an inlet opening 28 that allows exhaust gases to flow into the impeller cavity due to the rotation of the impeller 30. As illustrated in FIG. 1, the impeller 30 is a conventional squirrel cage impeller having a plurality of forward curved impeller blades 32 each attached to a back plate 34 and extending axially therefrom. An inlet ring typically extends between the axial outer edges of the impeller blades to provide support for the impeller blades as the impeller 30 rotates within the impeller cavity 18. As can be understood by the previous description, the squirrel cage impeller 30 is fabricated from numerous metal components that must be joined to each other using metal joining techniques. Thus, the cost of the squirrel cage impeller 30 includes the labor costs required to fabricate and assembly the numerous components into the structure shown.

As illustrated in FIG. 1, the prior art blower assembly 10 includes a slinger fan 36 mounted to the drive shaft 16 and positioned beneath a shroud to the exterior of the top wall 38 of the blower housing 20. The slinger fan 36 rotates along with the rotation of the drive shaft 16 and draws a flow of air over the drive motor 14 to cool the motor 14. In addition to drawing the air over the motor 14, the slinger fan 36 creates a buffer of air between the operating electronics of the drive motor 14 and the heated exhaust gases contained within the impeller cavity 18. Thus, the slinger fan 36 aids in preventing the overheating of the drive motor 14 during operation of the blower assembly 10.

As can be understood in FIG. 1, the inclusion of the slinger fan 36 on the drive shaft 16 increases the mass of the drive shaft and the resistance to rotation seen by the drive motor 14. Thus, in order for the impeller 30 to rotate at the speed required to create the desired flow characteristics, the power and thus the size of the drive motor 14 must be increased, which decreases the operating efficiency of the entire blower assembly 10 and increases the costs.

Figure 2:
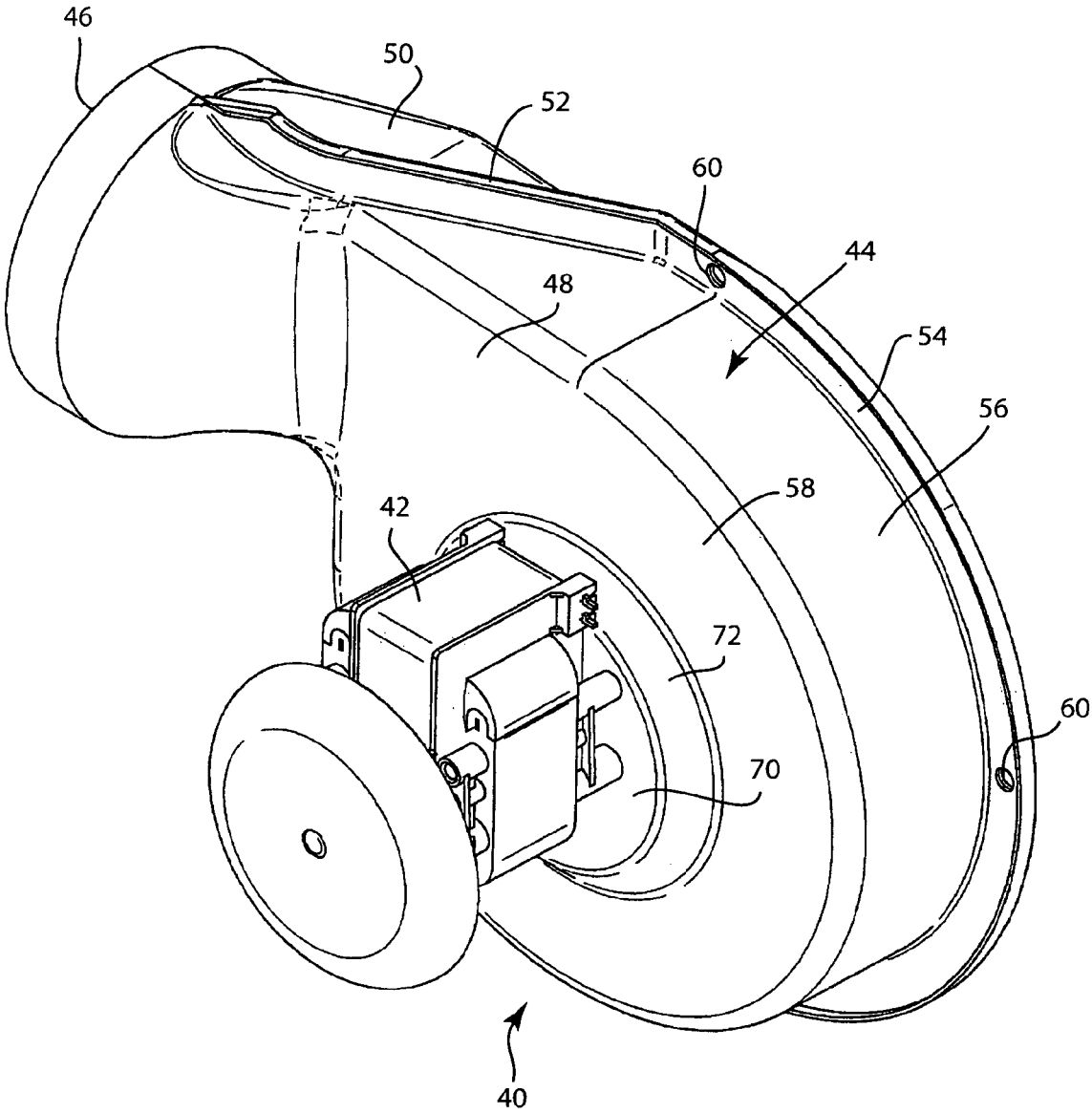
FIG. 2 is a front perspective view of the blower assembly of the present invention.

Referring now to FIG. 2, thereshown is the blower assembly 40 of the present invention. The blower assembly 40 includes a drive motor 42 mounted to a blower housing 44 having an exhaust outlet 46. As with the prior art blower assembly 10 shown in FIG. 1, the blower housing 44 is formed from a first housing section 48 and a second housing section 50 joined to each other along a peripheral outer edge 52. In the embodiment of the invention illustrated, both the first housing section 48 and the second housing section 50 are formed from stamped metal such that the blower housing 44 can withstand the elevated temperatures of the exhaust gases drawn into the blower housing 44 by the rotating impeller. A detailed discussion of the housing 44 is included in U.S. Pat. No. 6,468,034, the disclosure of which is incorporated herein by reference.

Figure 3:
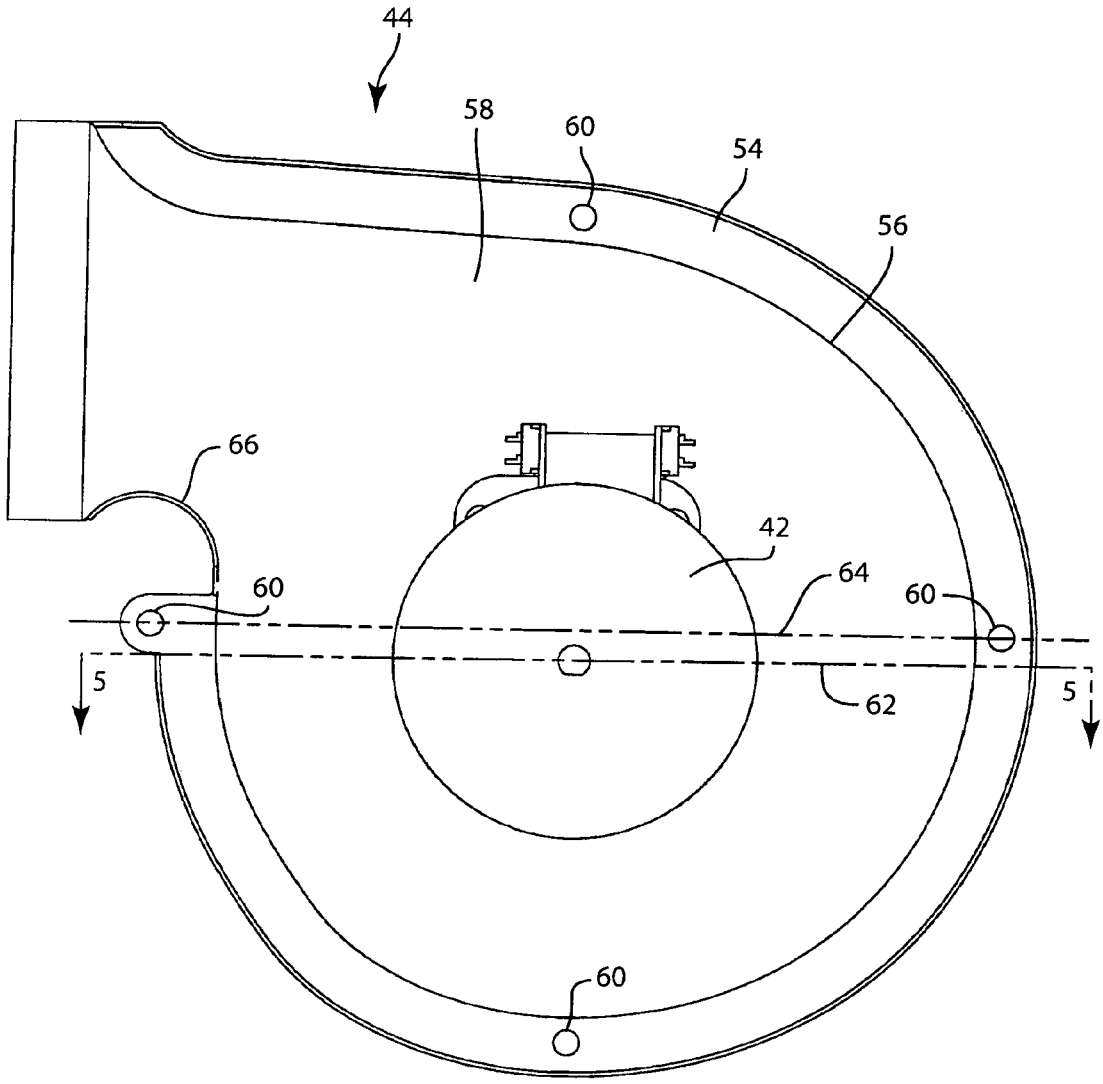
FIG. 3 is a top view of the blower assembly of the present invention.
Figure 4:
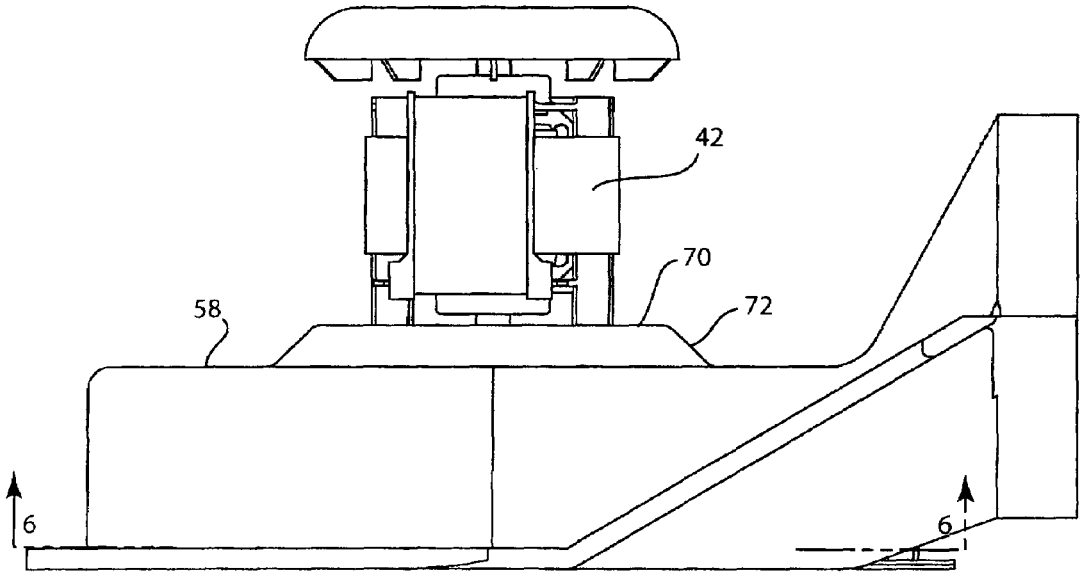
FIG. 4 is a side view of the blower assembly of the present invention.

As illustrated in FIG. 2, the blower housing includes an outer attachment flange 54 that extends outward from a perpendicular outer wall 56. The outer wall 56 of the first housing section 48 extends upward and is joined to the top wall 58. The attachment flange 54 of the first housing section 48 includes four spaced attachment openings 60 that are aligned with similar openings in the second housing section 50. The spaced openings 60 allow the blower housing 44 to be flush mounted to a furnace or other equipment. As illustrated in FIG. 3, the attachment openings 60 are spaced 90° from each other on a diameter whose center is at the inlet center such that the orientation of the blower housing 44 can be oriented in any one of four orthogonal positions on a furnace.

As can be seen in FIG. 3, the centerline of the drive motor 42, as illustrated by line 62, is slightly offset from the centerline 64 of the blower housing 44. The centerline 64 extends between the pair of spaced attachment openings 60, as illustrated by line 64. The offset of the drive motor 42 from the centerline of the blower housing 44 allows for an increase in the diffuser angle between the rotation of the impeller and the cut off edge 66, which contributes to a higher blower efficiency. Further, the offset of the centerline 62 results in the reduction of the blade pass noise by moving the impeller further from the cut off edge 66.

Figure 5:
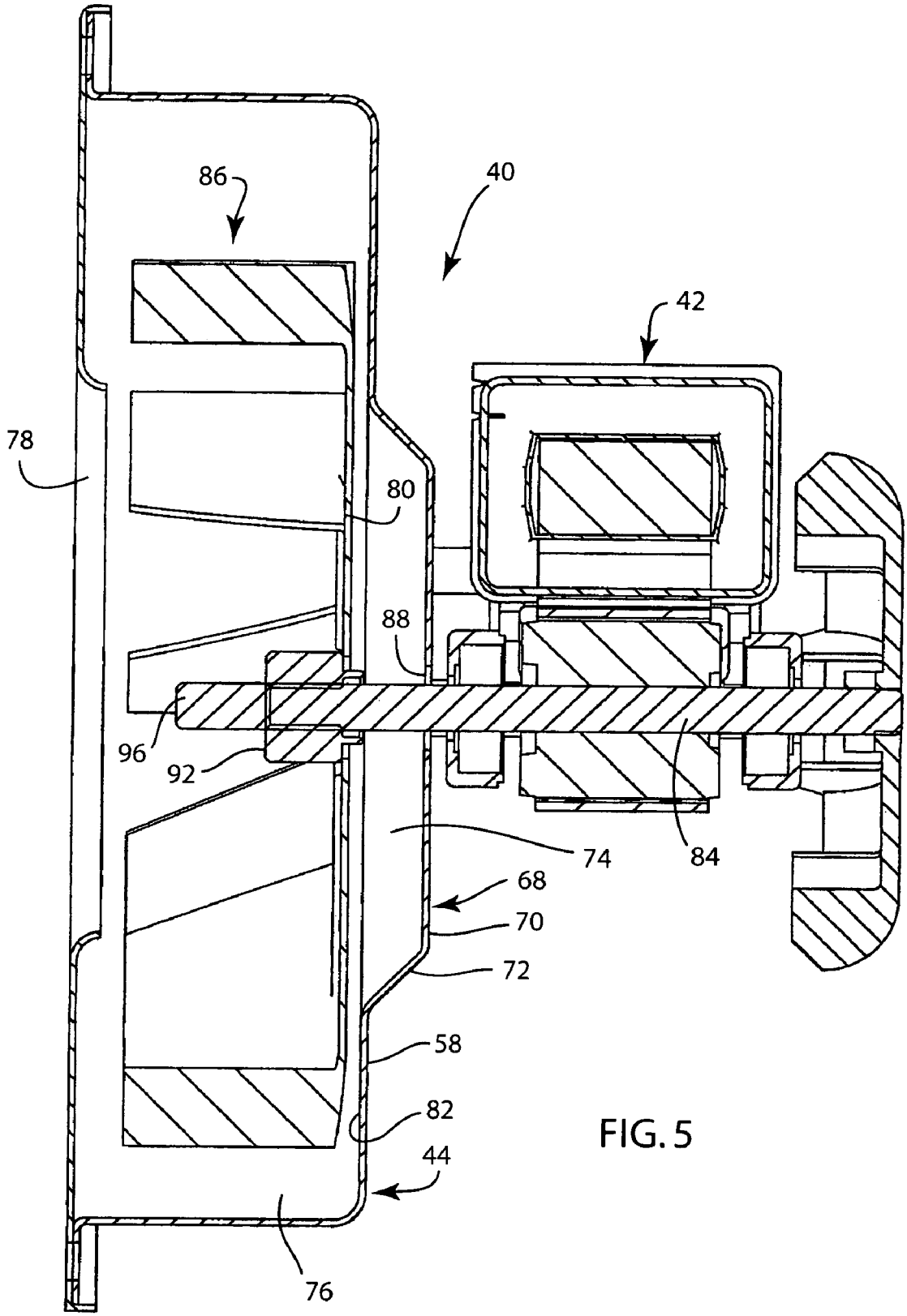
FIG. 5 is a section view taken along line 5—5 of FIG. 3.

Referring now to FIG. 5, thereshown is a section view of the blower assembly 40 of the present invention. As illustrated in FIG. 5, the top wall 58 of the blower housing 44 includes a raised plenum 68 that extends away from the top wall 58. Specifically, the plenum 68 includes a plenum top wall 70 that is spaced axially from the top wall 58 of the housing 44 by an angled wall 72. As can be seen in FIG. 2, the angled wall 72 spaces the plenum top wall 70 from the top wall 58 and provides a point of attachment for the drive motor 42.

Referring back to FIG. 5, the plenum 68 defines an internal plenum cavity 74. The plenum cavity 74 is in fluid communication with the open impeller cavity 76 such that the negative pressure created in the impeller cavity 76 can draw exhaust gases in through the inlet opening 78 and a small amount of ambient air into the plenum cavity 74.

Specifically, a small amount of air enters into the plenum cavity 74 through a clearance opening 88 that exists between the plenum top wall 70 and the drive shaft 84. Thus, as the impeller 86 rotates within the impeller cavity 76 to create a source of negative pressure, fresh air at ambient temperature is drawn into the plenum cavity 74 of the raised plenum 68 such that the raised plenum 68 creates a buffer of cooler air between the impeller cavity 76 and the drive motor 42.

Additionally, the close tolerance between the back wall 80 of the impeller 86 and the inner surface 82 of the top wall 58 restricts the flow of exhaust gases into the plenum cavity 74 defined by the raised plenum 68. Thus, during normal operation of the drive motor 42 and the related rotation of the drive shaft 84 and the impeller 86, a buffer of reduced temperature air exists around the drive shaft 84.

Figure 6:
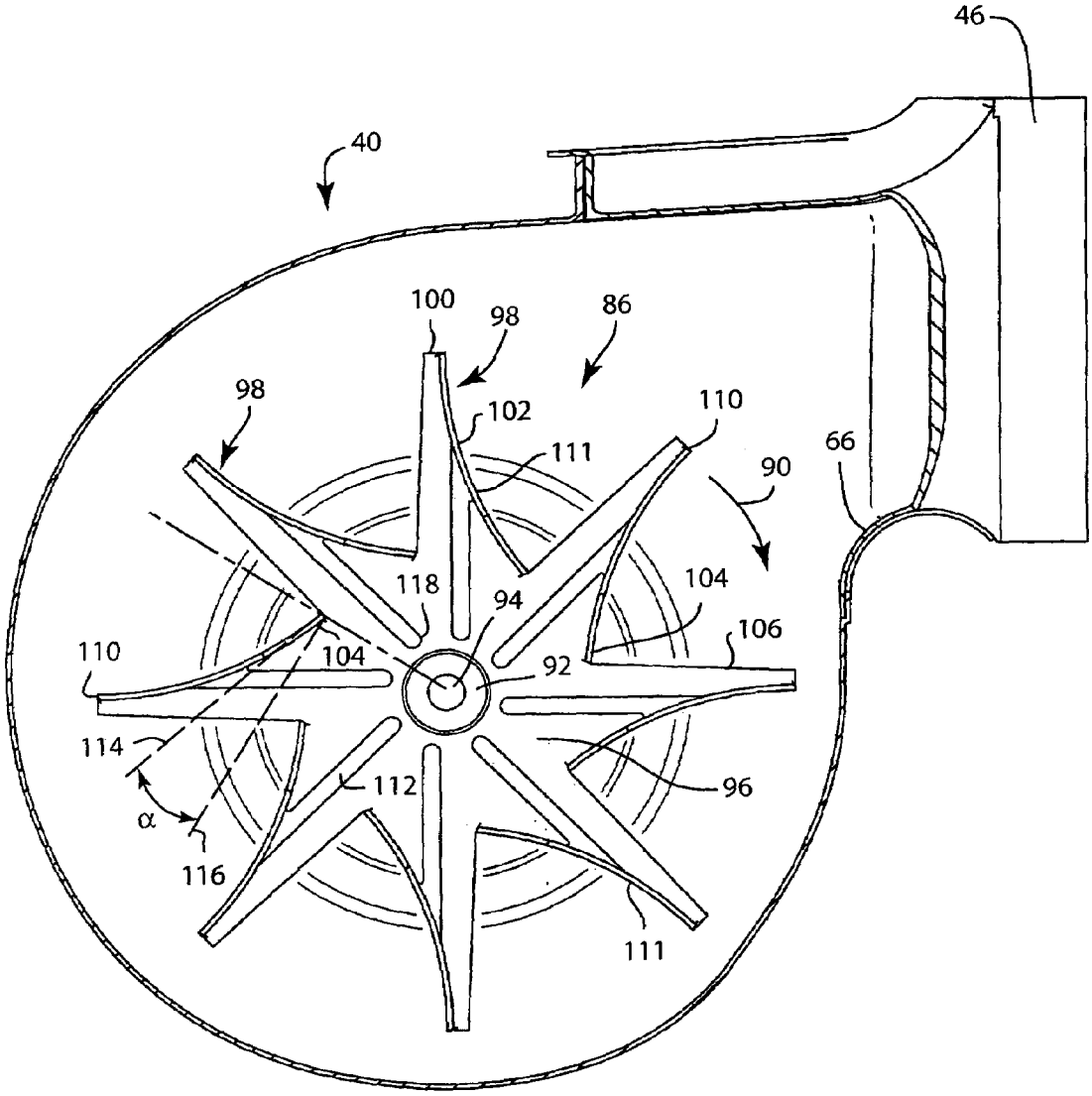
FIG. 6 is a section view taken along line 6—6 of FIG. 4.

Referring now to FIG. 6, thereshown is the specific configuration of the impeller 86 utilized in the blower assembly 44 of the present invention. The impeller 86 rotates in the clockwise direction within the housing, as illustrated by arrow 90 in FIG. 6. As the impeller 86 rotates, exhaust gases are expelled radially through the exhaust outlet 46. The exhaust outlet 46 is coupled to an exhaust pipe (not shown) which directs the exhaust gases out of the building in which the blower assembly 40 is mounted. The blower housing 44 defines the cut off edge 66 which aids in directing the flow of exhaust gases out of the exhaust outlet 46. The cutoff 66 is of a sufficient radius (approximately 0.75 inches or greater) to prevent a blade pass pure tone.

Figure 7:
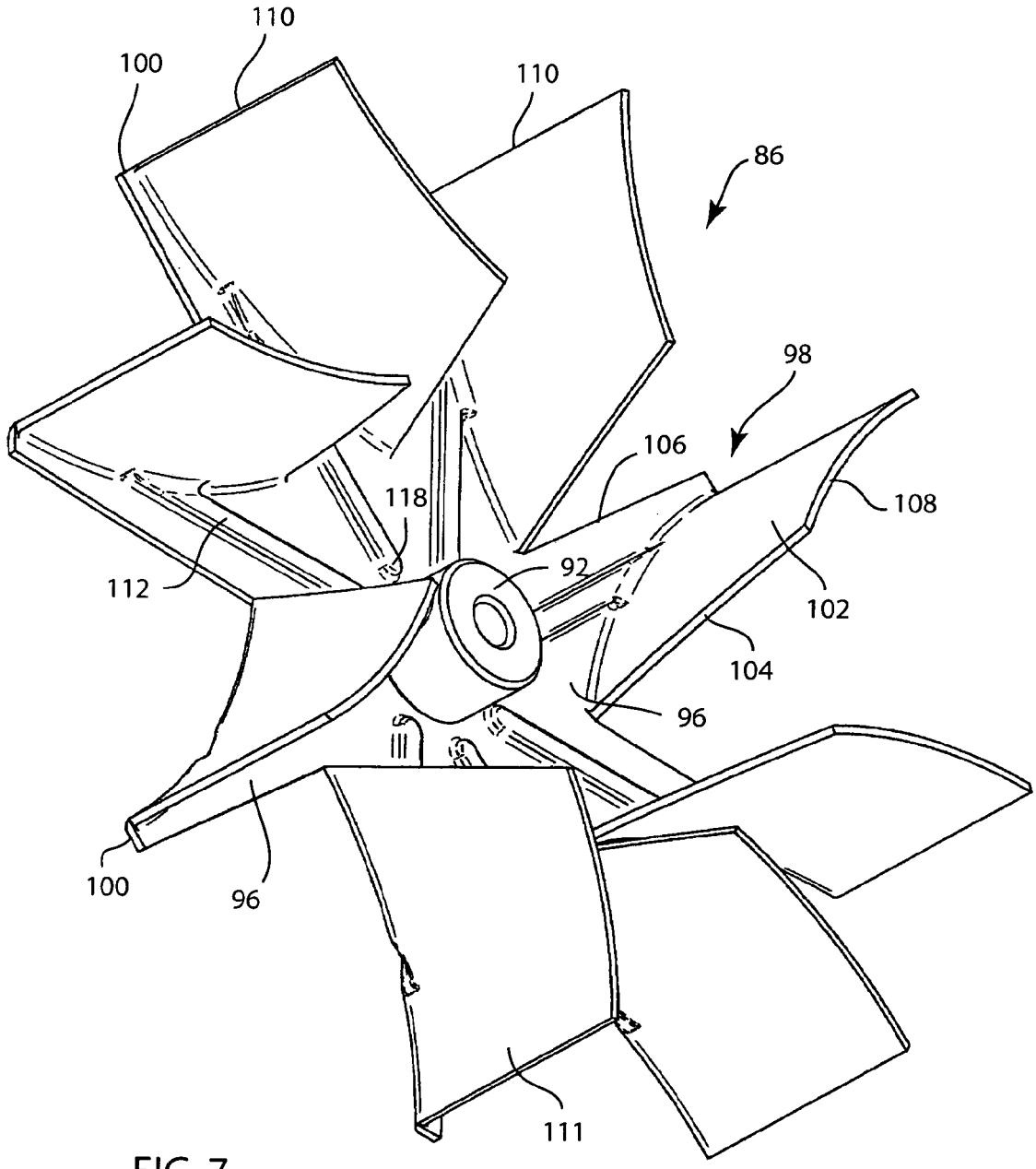
FIG. 7 is a perspective view of the one-piece sheet metal impeller utilized in the blower assembly of the present invention.

As can be seen in FIGS. 6 and 7, the impeller 86 of the present invention includes a central mounting hub 92 including a central opening 94. As illustrated in FIG. 5, the mounting hub 92 receives the outer end 96 of the drive shaft 84 and secures the impeller 86 to the rotating drive shaft 84.

Referring back to FIG. 6, the mounting hub 92 is secured to the back wall 96 of the impeller using conventional metal joining techniques. In the preferred embodiment of the invention, the entire impeller 86 is formed from a single sheet of metallic material, such as sheet metal, that is cut, stamped and bent into the configuration illustrated in FIGS. 6 and 7. The single piece metal impeller 86 decreases the cost to produce the impeller 86 as compared to a squirrel cage impeller shown in FIG. 1. Additionally, the specific configuration of the impeller 86 allows the performance characteristics of the impeller 86 to meet with desired standards for the blower assembly 40 of the present invention.

Referring back to FIG. 6, the impeller 86 includes a plurality of individual impeller blades 98. Each of the impeller blades 98 terminates at an outer blade tip 100 that is approximately radially spaced from the central opening 94.

Referring now to FIG. 7, each of the impeller blades 98 includes an upstanding blade portion 102 that extends perpendicular to the back wall 96 and generally parallel to the rotational axis of the impeller 86. During the initial formation of the impeller 86, the shape of the blade portion 102 is stamped from a planar sheet of metal material. After the shape of the blade is formed, the blade portion 102 is bent upward into the condition shown in FIG. 7. As illustrated in FIG. 7, the leading edge 104 of each blade portion 102 is perpendicular to the back wall trailing edge 106 after the blade portion 102 has been bent upward. However, before this step, the leading edge 104 and the back wall trailing edge 106 are adjacent to each other. Each blade portion 102 further includes a top edge 108, a radial outer edge 110 and a face surface 111. The radial outer edge 110 is joined to the back wall 96 and forms a portion of the blade tip 100.

Referring back to FIG. 6, each of the blade portions 102 is formed as a forward curved impeller blade in which the leading edge 104 is rotationally leading the trailing edge 106 of the blade portion 102.

As illustrated in FIG. 6, the face surface 111 of the blade portion 102 is curved in the direction of rotation such that the line 114 drawn tangent to the leading edge 104 forms an inlet angle $\alpha$ with a line tangent to the impeller inlet diameter, as illustrated by reference number 116. The smaller inlet angle $\alpha$ increases the efficiency of the impeller 86 as compared to a prior art impeller having impeller blades that extend radially from the center of the impeller. In the preferred embodiment of the invention, the inlet angle $\alpha$ is between 15° and 25°.

As illustrated in FIG. 7, the back wall 96 of the impeller 86 includes a series of protruding ribs 112 each associated with one of the impeller blades 98. The ribs 112 extend from the otherwise planar back wall 96 and provide additional strength for each of the impeller blades 98, and specifically the upstanding blade portion 102. The ribs 112 are formed during the stamping and formation process of the impeller and extend to an inner end 118 spaced slightly from the mounting hub 92.

Figure 8:
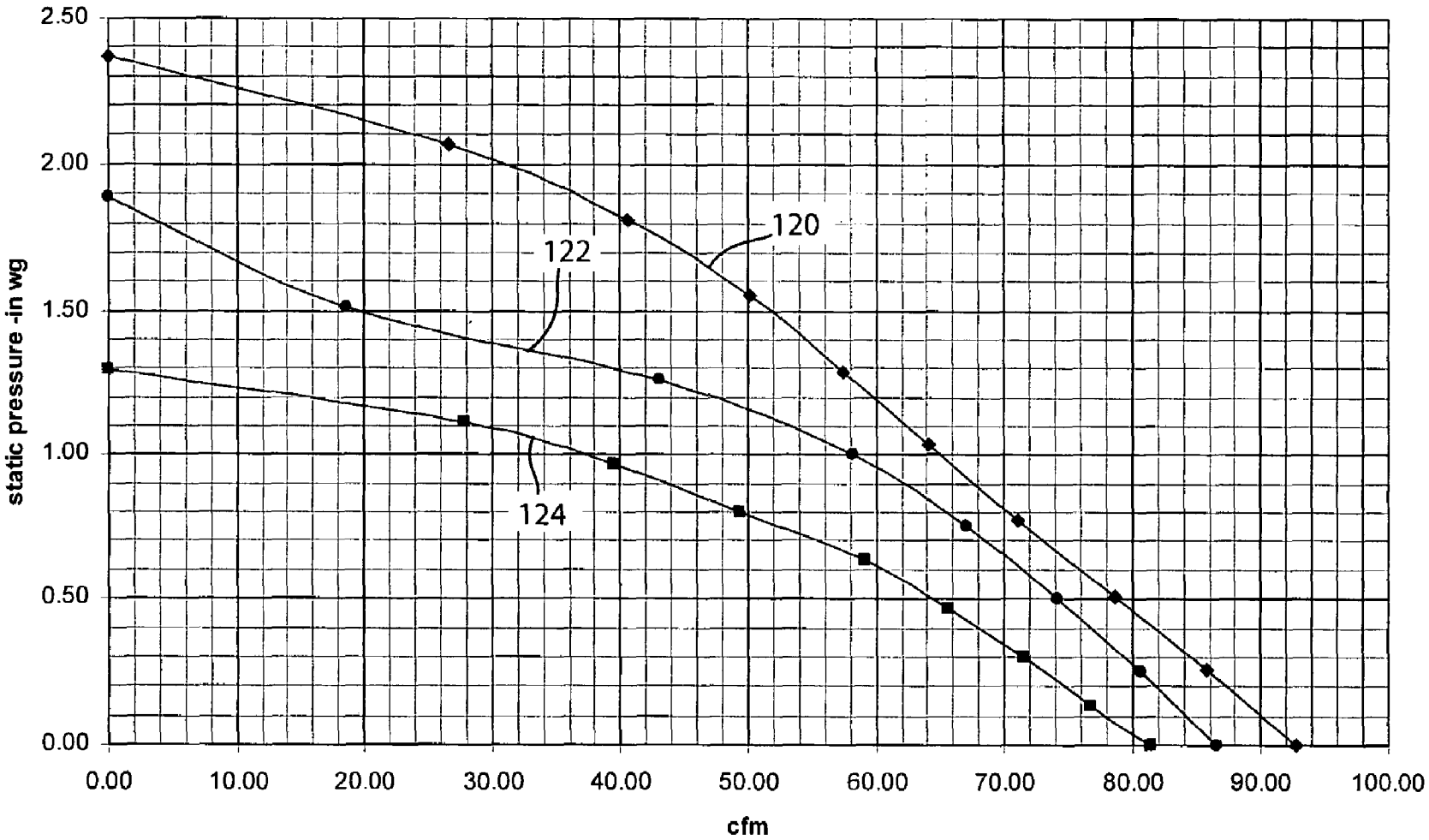
FIG. 8 is a graph illustrating the pressure developed by the blower assembly of the present invention as compared to prior art blower assemblies.

Referring now to FIG. 8, thereshown is a graphic illustration of the static pressure created by the blower assembly 40 of the present invention as compared to prior art blower assemblies. Specifically, line 120 in FIG. 8 illustrates the performance curve of the blower assembly 40 illustrated in FIGS. 2–7. Line 122 illustrates a blower assembly having a squirrel cage impeller, similar to the prior art blower assembly shown in FIG. 1, while line 124 illustrates the performance curve for a blower assembly having a radial paddle wheel formed from stamped sheet metal. As can be clearly illustrated in FIG. 8, the blower assembly 40 of the present invention, including the one-piece, stamped sheet metal impeller having backward inclined, forward curved impeller blades provides for an increase in performance as compared to prior art blower assemblies.

Figure 9:
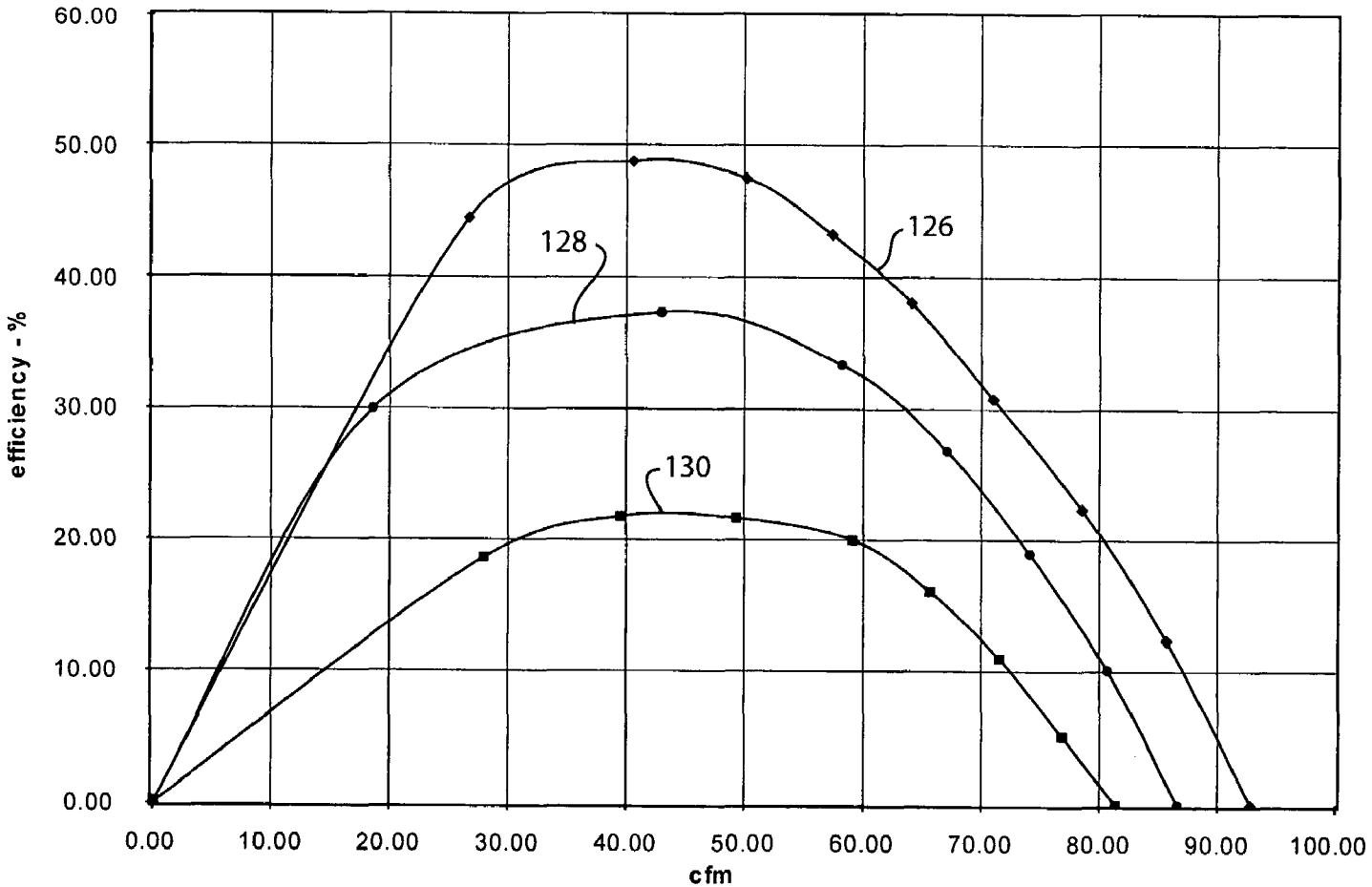
FIG. 9 is a graph illustrating of the operating efficiency of the blower assembly of the present invention as compared to prior art blower assemblies.

Referring now to FIG. 9, thereshown is an efficiency chart illustrating the comparison between the blower assembly 40 of the present invention and prior art blower assemblies previously described. Line 126 in FIG. 9 illustrates the blower assembly 40 utilizing the stamped, one-piece forward curved sheet metal impeller 86 of the present invention. Line 128 illustrates a blower assembly having a squirrel cage impeller, while line 130 illustrates a blower assembly having a radial paddle wheel impeller. Clearly, the blower assembly illustrated by line 126 operates the most efficiently over the broadest range of air flows. The increase in the efficiency as illustrated by line 126 allows a blower assembly of the present invention to be operated with a smaller power motor, thereby decreasing the overall cost of the blower assembly.

Various alternatives and embodiments are contemplated as being within the scope of the following claims particularly pointing out and distinctly claiming the subject matter regarded as the invention.

I claim:

1. A blower assembly for use in expelling gases from a furnace through an exhaust pipe comprising:

a blower housing having an internal impeller cavity defined by an outer wall and a top wall, the blower housing having an inlet opening for receiving exhaust gases from the furnace;

a drive motor mounted to the blower housing, the drive motor including a drive shaft extending through the blower housing and into the impeller cavity; and an impeller mounted to the motor shaft and contained within the impeller cavity, the impeller being formed from a single sheet of metal and having a plurality of impeller blades, wherein each of the impeller blades are backward inclined and forward curved;

wherein each of the impeller blades includes a blade portion extending from a leading edge to a trailing edge, each of the blade portions being bent perpendicular to an impeller back wall to an operating condition, each impeller blade including a back wall trailing edge, wherein the leading edge of each impeller blade portion is directly adjacent the back wall trailing edge of an adjacent impeller blade prior to the impeller blade portion being bent 90° into its operating position.

2. The blower assembly of claim 1 wherein the impeller is formed from a single piece of stamped steel.

3. The blower assembly of claim 1 wherein each of the impeller blades is backward inclined and forward curved with an inlet angle of between 15° and 25°.

4. The blower assembly of claim 1 wherein a generally planar back wall has a plurality of reinforcing ribs each aligned with one of the impeller blades.

5. The blower assembly of claim 1 further comprising a raised plenum extending from the top wall of the blower housing to define a plenum cavity, the plenum cavity being in fluid communication with the impeller cavity.

6. The blower assembly of claim 5 wherein the blower housing and raised plenum are formed from a single piece of stamped steel.

7. The blower assembly of claim 5 wherein the raised plenum includes a plenum top wall separated from the top wall of the blower housing by an angled sidewall, wherein the angled sidewall and the plenum top wall are integrally formed with the blower housing top wall and define the plenum cavity.

8. The blower assembly of claim 5 wherein the drive shaft of the drive motor extends through an opening formed in the raised plenum, wherein rotation of the impeller in the impeller cavity draws a flow of air into the plenum cavity through the opening surrounding the drive shaft.

9. The blower assembly of claim 8 wherein a back wall of the impeller is closely spaced from the top wall of the blower housing and overlies the plenum cavity, wherein the back wall of the impeller restricts the flow of exhaust gases from the impeller cavity into the plenum cavity.

* * * * *